US007334585B2

(12) United States Patent
Anzevino

(10) Patent No.: US 7,334,585 B2
(45) Date of Patent: Feb. 26, 2008

(54) MICROWAVABLE HAIR CURLER AND METHOD OF USING THE SAME

(76) Inventor: Laura J. Anzevino, 1744 E. Midlothian Blvd., Youngstown, OH (US) 44502

( * ) Notice: Subject to any disclaimer, the term of this patent is extended or adjusted under 35 U.S.C. 154(b) by 98 days.

(21) Appl. No.: 11/212,526

(22) Filed: Aug. 26, 2005

(65) Prior Publication Data

US 2006/0042649 A1 Mar. 2, 2006

Related U.S. Application Data

(60) Provisional application No. 60/605,920, filed on Aug. 30, 2004.

(51) Int. Cl.
*A45D 2/20* (2006.01)
*A45D 2/00* (2006.01)

(52) U.S. Cl. ..... 132/247; 132/222

(58) Field of Classification Search ..... 132/247, 132/212, 220, 222, 223, 226, 227, 233, 251, 132/262, 264
See application file for complete search history.

(56) References Cited

U.S. PATENT DOCUMENTS 1,538,809 A * 5/1925 Henry ..... 132/247
2,693,809 A * 11/1954 Spencer ..... 132/246
3,804,077 A * 4/1974 Williams ..... 126/263.1
3,902,508 A * 9/1975 Sliman, Sr. ..... 132/226
5,025,816 A * 6/1991 Jones ..... 132/247
5,411,040 A * 5/1995 Forrest ..... 132/211
5,819,763 A * 10/1998 Hallowell, II ..... 132/247
6,079,422 A 6/2000 Drago et al.
6,631,725 B2 10/2003 Gray
D503,017 S 3/2005 Mackinder
7,017,590 B2 * 3/2006 Mackinder ..... 132/233

* cited by examiner

*Primary Examiner*—Robyn Doan
(74) *Attorney, Agent, or Firm*—Sand & Sebolt

(57) ABSTRACT

A hair curler made from an elongated tubular member that is divided into three sections by constrictors. At least one of the sections is filled with a filler material, preferably tapioca. The tubular member is placed in a microwave oven for between 30 seconds and 1 minute 30 seconds and is then placed in the individual's hair. The hair curler is removed from the hair after 20 to 30 minutes. The elongated tubular member is made from a decorative stretchy fabric and consequently the hair curler has the appearance of a decorative hair accessory. The curler can therefore be worn out in public thereby allowing the individual to style their hair while conducting other tasks.

1 Claim, 2 Drawing Sheets

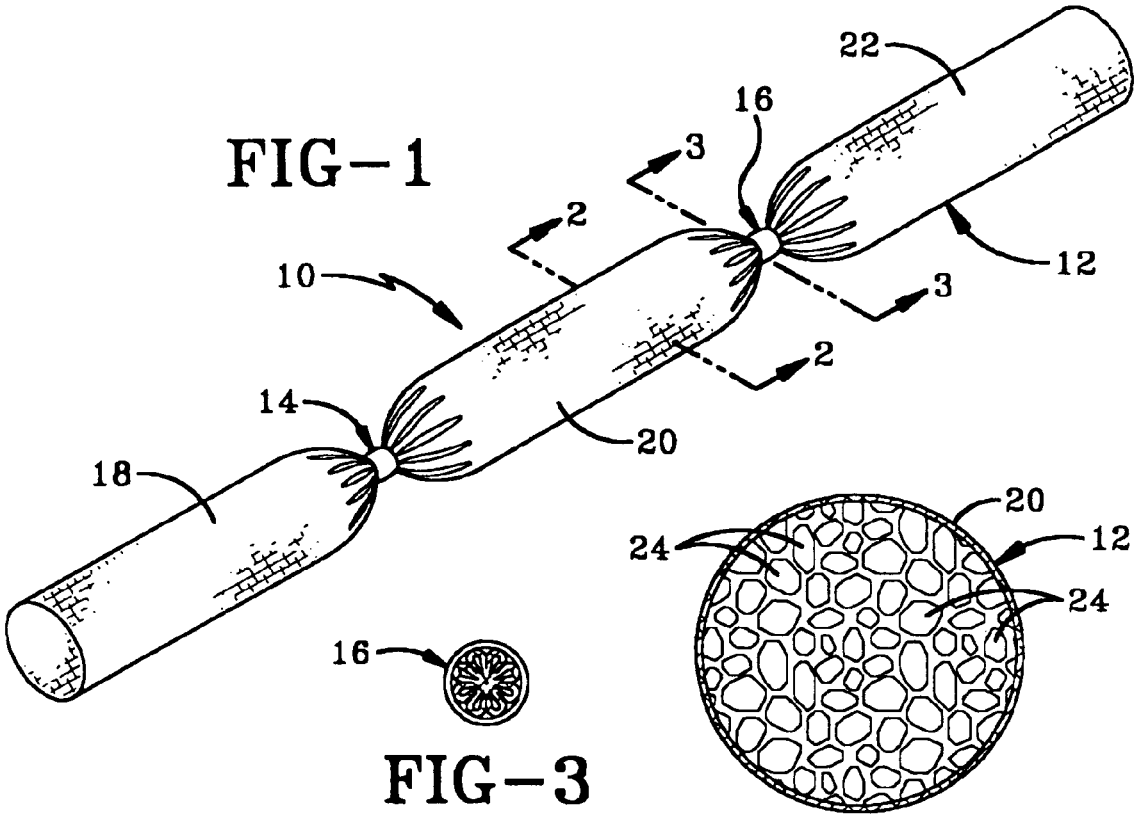
FIG-1
FIG-3
FIG-2
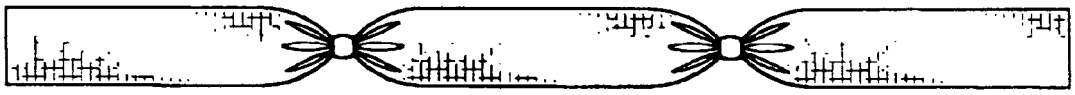
FIG-1A
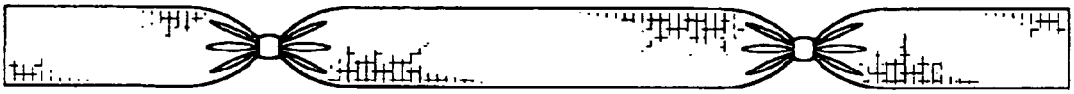
FIG-1B
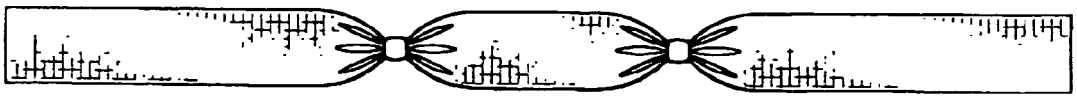
FIG-1C

MICROWAVABLE HAIR CURLER AND METHOD OF USING THE SAME

CROSS-REFERENCE TO RELATED APPLICATIONS

This is a standard utility application which claims priority from U.S. Provisional Application Ser. No. 60/605,920, filed Aug. 30, 2004, the entire specification of which is incorporated herein by reference.

BACKGROUND OF THE INVENTION

Technical Field

This invention generally relates to hair styling devices. More particularly, the invention relates to a hair styling device that is heatable in a microwave oven. Specifically, the invention relates to a flexible hair curler filled with a microwave heatable substance.

BACKGROUND INFORMATION

For centuries women have found ways to style their hair in appealing designs. They have used many methods and devices for both straightening their hair and conversely for shaping their hair into waves, curls and ringlets. Various types of curlers or rollers have been used to produce the desired curls in the desired locations on the head. Curlers have a cylindrical body which is rolled into the hair. The individual stands or sits in an upright position, grasps a section of hair, brushing or combing that section of hair upwardly and outwardly away from the scalp so that the hairs extend substantially straightly from the scalp outwardly to the tips. The curler is placed proximate the tips of the hair strands and in a perpendicular orientation relative to the strands of hair, the tips of the hairs are wrapped around the curler and the curler is then rotated inwardly toward the scalp, rolling the strands of hair thereon until the curler lies proximate the scalp. The curler is then secured into place. The curler is left in place for some time, the length of time dictating the type of curl that are ultimately produced. It has also been found that moisture aids in the formation of curls and consequently it is preferable that the curler be placed in damp hair. Alternatively, the curler may be placed in dry hair and then a mister could be used to add a small quantity of moisture to the hair.

The types of curlers used over the years have ranged from foam rubber rollers, to hardened plastic rollers to electrically heated curling irons. Foam rubber curlers were typically placed into wet hair and then left in place until the hair dried. The drying could be hastened by using a hand-held hair dryer or a drying hood which was positioned over the entire head and required that the individual sit under it until their hair had fully dried. Hard plastic rollers could similarly be placed in wet hair and left therein until the hair dried. This could be accomplished naturally over several hours or using a hair dryer or hood in a shorter span of time. Other plastic curlers were preheated prior to insertion into the hair by placing the curlers over hot metal rods disposed in a specially designed device. These curlers help dry the hair more rapidly and tend to produce more long-lasting curls because of the application of moist heat to the hair strands. Foam curlers were reasonably comfortable to use because they were soft and therefore could be slept in, but because they were soft and flexible they tended to be difficult to roll the hair onto and could produce uneven curls in the hands of less experienced hair stylists, because the foam could be compressed if the hair was rolled too tightly thereon. Plastic curlers on the other hand, are relatively easy to use because they can be easily grasped and the hair can be firmly rolled thereon. They are, however, extremely uncomfortable for the individual having their hair styled, especially if they are left in the hair over long periods of time. They are also extremely uncomfortable to sleep in. Both the foam and plastic curlers, if the hair is being naturally dried over time without the application of heat, give the individual the freedom to move around. However, they are also unsightly and therefor while the individual can move around, they tend not to want to be seen in public with the curlers in their hair. The individual has to therefor plan when to curl their hair and has to allow sufficient time to allow the hair to dry in the curlers before they can leave their home. This problem has been somewhat addressed in the prior art by the invention of the curling iron. Curling irons typically are electrical devices that include a metal rod which is heated. The hair is wrapped around the metal rod and left in place for a short period of time. The rod is then withdrawn from the hair, leaving a curl behind. The device therefore requires that the individual spend some time in front of a mirror forming curls in their hair. Some curling irons operate on butane or batteries and are therefore completely portable so that the individual does not necessarily have to curl her hair at home. However, as with other previous curlers, the curling iron requires that a substantial block of time be set apart for the individual to curl their hair—they cannot go and drive to work or run errands in public while the are curling their hair.

There is therefore a need in the art for an improved curler which is quick and simple to use, is comfortable for sleeping, is lightweight even when left in the hair for several hours, which emits no odors and which can be used in public while the individual is performing other tasks.

SUMMARY OF THE INVENTION

The device of the present invention comprises an elongated tubular member that is divided into three sections. Preferably, the tubular member is manufactured from one single piece of fabric. At least one of the sections of the tubular member is filled with a heatable filler material, preferably tapioca. The tubular member is placed in a microwave oven for between 30 seconds and 1 minute 30 seconds. The curler is applied to the hair in a manner that differs from the way curlers are typically positioned in hair. In the present invention, the individual bends over and grasps a section of hair, brushing or combing that section of hair forwardly so that the hairs extend substantially straightly from the scalp outwardly to the tips. The filled section of the curler is placed proximate the tips of the hair strands and in a perpendicular orientation relative to the strands of hair, the strands of the hairs are wrapped around the curler and the curler is rotated backwardly toward the back of the head and inwardly toward the scalp, rolling the strands of hair thereon until the curler lies proximate the scalp. The other sections of the tubular member are moved toward each other and are fastened together by any suitable means. This securement can be achieved in a variety of ways, but the preferred way is tying the unfilled sections of the curler together once and then applying a clamp-type hair clip over the knot and into the individual's hair. The curler is left in place for a period of time, the length of time dictating the type of curl that are ultimately produced. The tubular member preferably is made of a decorative flexible fabric and consequently when curler 10 is rolled in the hair, it has the appearance of a decorative hair accessory. This enables the individual to wear the curler out in public. Furthermore, the heating of the tubular member causes the hair wrapped around it to be shaped into a curl. A filler material which has been found to be excellent for the tubular member is tapioca. The tapioca easily absorbs heat and slowly releases the same. When the individual wishes to remove the curler, it can be done so by simply releasing the connection between the first and third sections of the tubular member.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

FIG. 1 is a perspective view of a microwavable hair curler in accordance with the present invention;

FIG. 1A is a side view of a microwavable hair curler in which all three sections of the curler are substantially equal in length;

FIG. 1B is a side view of a microwavable hair curler in which the first and third sections are equal in length and the second section is longer than either of the first and third sections;

FIG. 1C is a side view of a microwavable hair curler in which the first and third sections are equal in length and the second section is shorter than either of the first and third sections;

FIG. 2 is a cross-sectional view through line 2-2 of FIG. 1;

FIG. 3 is a cross-sectional view through line 3-3 of FIG. 1;

DETAILED DESCRIPTION OF THE INVENTION

Figure 4:
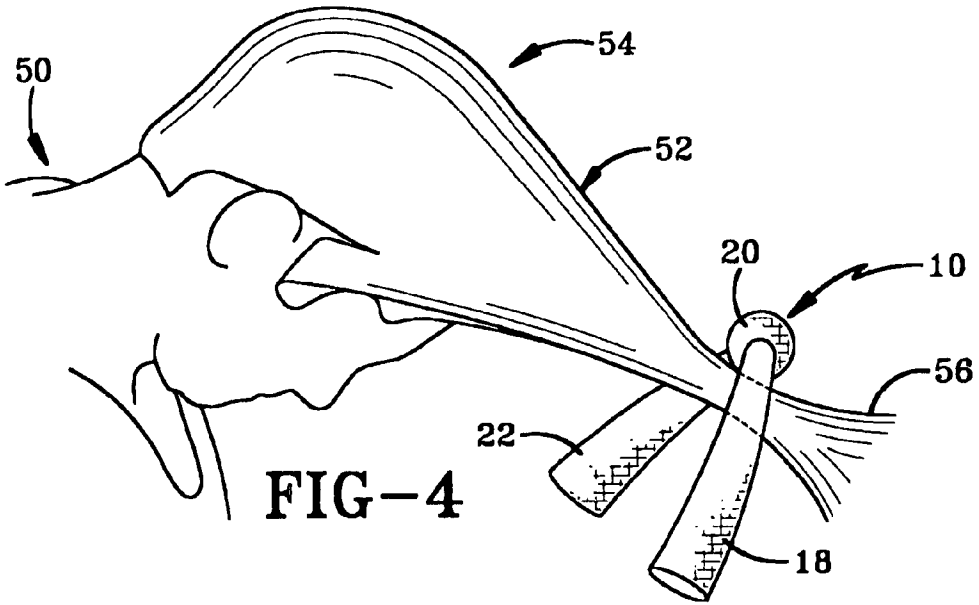
FIG. 4 is a schematic side view showing the microwavable hair curler being positioned for application into an individual's hair.

Referring to FIGS. 1-4, there is shown a microwavable hair curler in accordance with the present invention and generally indicated at 10. Curler 10 comprises an elongated tubular member 12 which is constricted at least at two locations, namely at constrictions 14, 16. Constrictions 14, 16 may be formed in a number of ways such as tying a knot into the fabric to form constrictions 14, 16. Alternatively, a band of suitable material can be tied around tubular member to substantially reduce the diameter of the same. Suitable constrictions 14, 16 may comprise ¼ inch pieces of ribbon or plastic clasps.

Tubular member 12 is thereby formed into at least a first section 18, second section 20 and third section 22. The lengths of first, second and third sections 18, 20, 22 may be made substantially identical (FIG. 1A). Alternatively, first and third sections 18, 22 may be of a substantially equal length and second section 20 may be longer than either of first and third sections 18, 22 to provide a longer curling surface (FIG. 1B). Alternatively, first and third sections 18, 22 are of substantially equal length and second section 20 may be shorter than either of first and third sections 18, 22 to provide a shorter curling surface (FIG. 1C).

Tubular member 12 preferably is made from fabric such as polyester, cotton or any other fabric which preferably is slightly stretchy and can withstand being heated in a microwave oven without melting or deteriorating in some other manner. Preferably, the fabric has a decorative outer surface to make tubular member 12 aesthetically appealing. Tubular member 12 has a length of between 13½ inches and 20½ inches and preferably between 17 inches and 18 inches. Second section 20 is between 5 inches and 7 inches long and preferably is 6½ inches long.

At least one of the first, second and third sections 18, 20, 22 is filled with a non-toxic filler material 24 which can be heated in a microwave oven and that will slowly release the heat gained during the time in the microwave oven. In a preferred embodiment, second section 20 is filled with filler material 24 and neither first and third section 18, 22 contain any filler material 24. Filler material 24 retained within second section 20 preferably is of a bead-like nature. A preferred bead-like filler material 24 which can be used in tubular member 12 is small pearl tapioca which typically has a diameter of about ⅛ inch. Tapioca absorbs heat easily and quickly in a microwave oven and slowly releases the heat over a period of time. Furthermore, it has been found that tapioca does not release any unpleasant odors when heated and a tubular member 12 having at least one of first, second or third section filled with tapioca, has been found to be repeatedly reheatable without breaking down. When second section 20 is filled with filler material 24, it preferably has a diameter of between 1 inch and 2 inches. Constrictions 14, 16 reduce the diameter of tubular member 12 in the vicinity thereof to a degree sufficient to prevent filler material 24 from escaping out of second section 20. First and third sections 18, 22 preferably are free of filler material.

Figure 5:
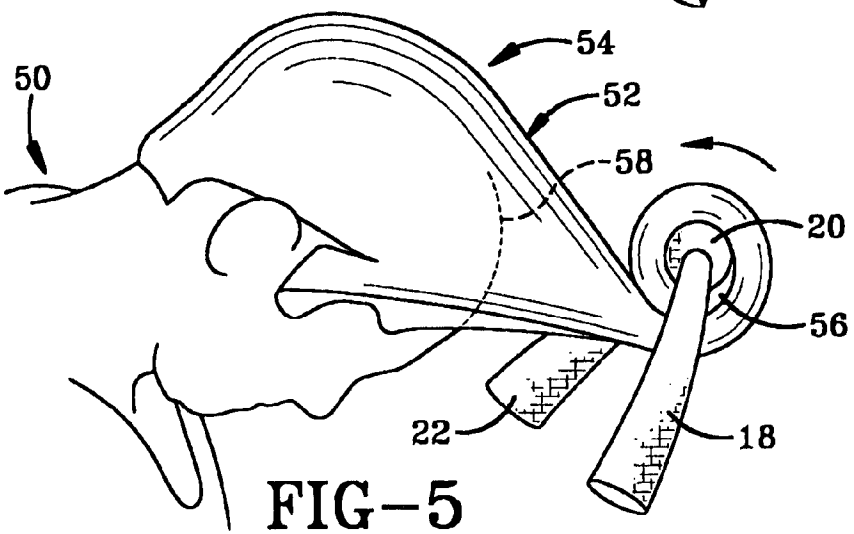
FIG. 5 is a schematic side view showing the curler being rolled into the hair.
Figure 6:
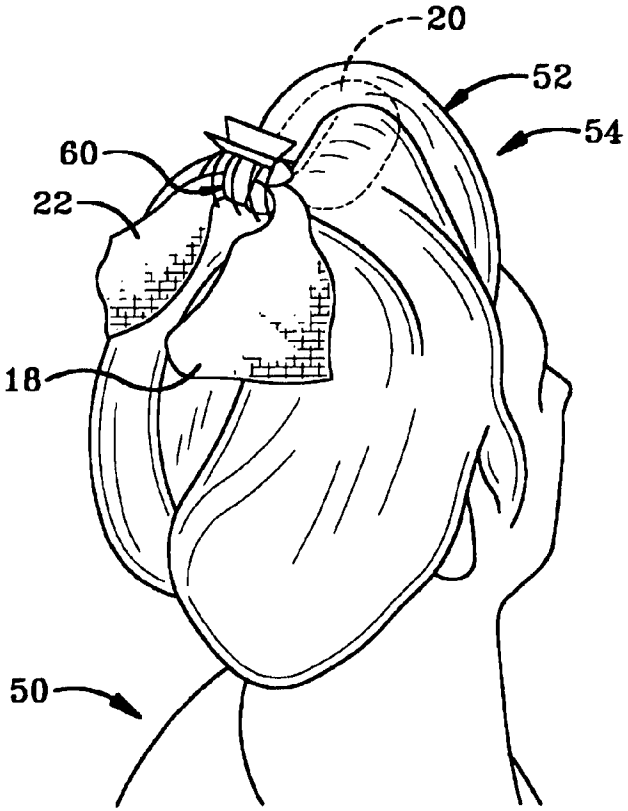
FIG. 6 is a schematic perspective rear view showing the curler fastened in place in the individual's hair.

It will be understood that while hair curler 10 has been shown herein as having first, second and third sections 18, 20, 22, curler 10 can have any number of desired sections separated from each other by constrictions. The sections may be filled with filler material 24 or may be unfilled in any desired combination so that curls can be formed at a variety of locations on the individual's head in a manner that will be hereinafter described Referring to FIGS. 4-6, hair curler 10 is used in the following manner. Hair curler 10 is placed in a microwave oven and is heated for between 30 seconds and 1 minute 30 seconds. Good results have been found when curler 10 is heated for 45 seconds. It has been found that the average heating time of a curler 10 in accordance with the present invention is around 45 seconds. If, after initial use, an individual finds that this heating time is not sufficiently long enough to form a curl of desired tightness and shape in their hair, the heating time can be increased in increments of 5 seconds on subsequent use until the appropriate length of heating time is determined for that particular person. While curler 10 is heating, the individual 50 brushes their hair 52 by bending over and gathering all of their hair together as shown in FIG. 4. The individual 50 can roll substantially all of their hair 52 onto curler 10, or alternatively, may separate a smaller section of hair and insert curler 10 into that section alone. Once curler 10 is heated through, second section 20 of curler 10 is positioned as shown in FIG. 4 adjacent the outermost tips 56 of the individual's hair 52. Curler 10 is then rolled rearwardly toward the back of the individual's head 54 and inwardly toward the scalp 58, wrapping hair 52 around second section 20. When second section 20 of curler 10 and the hair rolled thereon abuts the scalp 58, the first and third sections 18, 22 are moved toward each other and are secured together by a suitable means. In the preferred embodiment of the invention, first and third sections 18, 22 are moved toward each other, are tied together once and then secured by way of a clip 60. Any other method of inserting curler 10 into hair 52 may be used, such as holding curler 10 in place and twisting or wrapping hair 52 around curler 10. Furthermore, any other manner of securing curler 10 together may be employed without departing from the spirit of the present invention. This may include the provision of snaps or hook and pile fasteners on one or more of the first, second and third sections 18, 20 and 22 of curler 10.

It has been found that the average cooling time of a curler 10 in accordance with the present invention is between 20 and 30 minutes. This is sufficient time to form a well shaped and tight curl in the hair of most persons. If a softer curl is desired, the curler 10 may be removed sooner from the hair. If a tighter curl is desired, curler 10 can be left in the hair for a longer period. Because of the softness and flexibility of curler 10 imparted by the tapioca, curler 10 can be easily and comfortably left in overnight and can be slept in without causing the discomfort felt with previously known curlers.

Furthermore, because of the flexibility and aesthetically appealing fabrics which are used to form tubular member, curler 10 has the appearance of a decorative hair accessory and can therefore be used to style the hair while the individual is out in public working, running errands, shopping and the like. Additionally, decorative hair clips, flowers etc. can be attached to one of the first and third sections to further enhance the appearance of the curler 10 if it is to be used in a public setting. Furthermore, because of the small size of the curler and the collapsible nature of the first and third sections 18, 22 thereof, curler 10 may be easily packed for transportation and can be easily carried in a purse or the like. It has been found that curler 10 produces highly satisfactory results when used in shoulder length or longer hair.

It will be understood that one or more curlers 10 can be heated in a microwave and positioned at desired locations around the individual's head to form a plurality of curls therein.

It will also be understood that more than one of first, second and third sections 18, 20, 22 may be filled with tapioca so that heat can be applied to the hair from more than one direction.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of forming a curl in hair of an individual comprising the steps of:

providing a single curler comprising an elongated tubular member manufactured from a flexible fabric with a decorative design on its outermost surface, said tubular member being round in cross-sectional shape and having a longitudinal axis, at least two constrictors positioned along the length of the tubular member at right angles to the longitudinal axis and thereby dividing the tubular member into first, second and third sections, said constrictors reduce the diameter of the tubular member in the vicinity thereof; wherein the tubular member being between 13½ inches and 20½ inches long; at least one of said sections being only filled with a plurality of pearl tapioca granules, said granules being of approximately ⅛ inch in diameter, said filled section being between 1 inch to 2 inches in diameter and between 5 inches to 7 inches long;

placing said single curler into a microwave;

heating said curler between 30 seconds and 1 minute 30 seconds in said microwave;

gathering all of the individual's hair into a single bundle of hair;

placing said filled section of said curler into the individual's hair so that the filled section lies substantially perpendicularly to said bundle of hair;

rolling said bundle of hair around an outside surface of said filled section so that substantially all of the individual's hair is rolled around the filled section of said single curler;

securing the curler in place;

leaving the curler in hair between 20 to 30 minutes;

removing said filled section of the curler from the individual's hair to reveal the curl formed thereby.

* * * * *